US007892106B2

(12) United States Patent
Matsunaga

(10) Patent No.: US 7,892,106 B2
(45) Date of Patent: Feb. 22, 2011

(54) IRON-TYPE GOLF CLUB HEAD AND GOLF CLUB SET

(75) Inventor: Kiyofumi Matsunaga, Kobe (JP)

(73) Assignee: SRI Sports Limited, Kobe (JP)

( * ) Notice: Subject to any disclaimer, the term of this patent is extended or adjusted under 35 U.S.C. 154(b) by 162 days.

(21) Appl. No.: 12/347,646

(22) Filed: Dec. 31, 2008

(65) Prior Publication Data

US 2009/0247314 A1 Oct. 1, 2009

(30) Foreign Application Priority Data

Mar. 28, 2008 (JP) ..... 2008-087456

(51) Int. Cl.
*A63B 53/04* (2006.01)

(52) U.S. Cl. ..... 473/290; 473/350

(58) Field of Classification Search ..... 473/290–291, 473/332, 349–350

See application file for complete search history.

(56) References Cited

U.S. PATENT DOCUMENTS

| | | | | |
|---|---|---|---|---|
| 2,846,228 | A * | 8/1958 | Reach | 473/332 |
| 5,104,457 | A * | 4/1992 | Viljoen et al. | 473/350 |
| 5,242,167 | A * | 9/1993 | Antonious | 473/350 |
| 5,316,298 | A * | 5/1994 | Hutin et al. | 473/332 |
| 5,330,187 | A * | 7/1994 | Schmidt et al. | 473/291 |
| 5,333,872 | A * | 8/1994 | Manning et al. | 473/291 |
| 5,409,229 | A * | 4/1995 | Schmidt et al. | 473/332 |
| 5,605,511 | A * | 2/1997 | Schmidt et al. | 473/324 |
| 5,707,302 | A * | 1/1998 | Leon et al. | 473/324 |
| 5,823,887 | A * | 10/1998 | Mikame et al. | 473/290 |
| 5,971,868 | A * | 10/1999 | Kosmatka | 473/349 |
| 6,120,388 | A * | 9/2000 | Blough et al. | 473/291 |
| 6,344,001 | B1 * | 2/2002 | Hamada et al. | 473/329 |
| 6,554,722 | B2 * | 4/2003 | Erickson et al. | 473/334 |
| 7,390,270 | B2 * | 6/2008 | Roberts et al. | 473/332 |
| 7,731,604 | B2 * | 6/2010 | Wahl et al. | 473/337 |
| 7,789,771 | B2 * | 9/2010 | Park et al. | 473/332 |
| 2008/0318705 | A1 * | 12/2008 | Clausen et al. | 473/291 |

FOREIGN PATENT DOCUMENTS

EP 0 642 812 A2 3/1995

* cited by examiner

*Primary Examiner*—Stephen L. Blau
(74) *Attorney, Agent, or Firm*—Birch, Stewart, Kolasch & Birch, LLP

(57) ABSTRACT

An iron-type golf club head has a face portion which comprises a central part, a face peripheral part surrounding the central part and protruding backward therefrom to form a cavity, and a badge disposed within the cavity. The central part comprises: a central thin region having a minimum thickness of the face portion and a rear surface to which the badge is attached; a thicker peripheral region surrounding the badge and having an inner circumferential surface raising from the rear surface of the central thin region to position the badge, the thicker peripheral region having at least one breaking part; and at least one radial thin region formed by the breaking part and extending from the central thin region to the face peripheral part.

7 Claims, 9 Drawing Sheets

A-A section

A-A section

A-A section

IRON-TYPE GOLF CLUB HEAD AND GOLF CLUB SET

BACKGROUND OF THE INVENTION

The present invention relates to an iron-type golf club head provided with an open cavity in which a badge is disposed, more particularly to a structure for the back of the face portion to which the badge is adhered.

In general, an iron-type golf club head (a) is provided with an open cavity (c) behind the face portion (b), and within the cavity (c), a badge (d) is disposed for decorative purpose and/or indicating the manufacturer name, logo and the like, for example as shown in FIGS. 7(*a*) and 7(*b*).

When the rear surface of the face portion (b) is flat as shown in FIG. 7(*b*), there is a tendency that the bonding position of the badge (d) becomes unstable. In other words, the accurate positioning of the badge (d) during bonding is difficult. Further, depending on the adhesive agent used, there is a possible that the badge (d) is moved by large impact shocks during use.

In European Patent Application Publication EP-0642812-A2, an iron-type golf club head provided with a badge (d) is disclosed, wherein as shown in FIGS. 9(*a*) and 9(*b*), the badge (d) is surrounded by a narrow-width rib (j) extending continuously along the outline of the badge (d) and independently from a peripheral wall (k).

Such rib (j) will make the positioning easy, but there is a tendency that the durability of the face portion is decreased since a large stress at impact tends to concentrate on the narrow rib (f).

SUMMARY OF THE INVENTION

It is therefore, an object of the present invention to provide an iron-type golf club head, in which the defects concerning the badge can be solved without deteriorating the durability, and further it becomes possible to improve the carry distance of the ball.

According to the present invention, an iron-type golf club head comprises a hosel portion and a face portion having a front surface forming a club face, the face portion comprising a central part, a face peripheral part surrounding the central part and protruding backward therefrom to form a cavity, and a badge disposed within the cavity, wherein the central part comprises:

a central thin region having a minimum thickness of the face portion and a rear surface to which the badge is attached;

a thicker peripheral region surrounding the badge and having at least one breaking part, the thicker peripheral region having an inner circumferential surface for positioning the badge, raising from the rear surface of the central thin region adjacently to the outer circumferential surface of the badge; and at least one radial thin region formed by the at least one breaking part, and extending from the central thin region to the face peripheral part.

DESCRIPTION OF THE PREFERRED EMBODIMENTS

Figure 1:
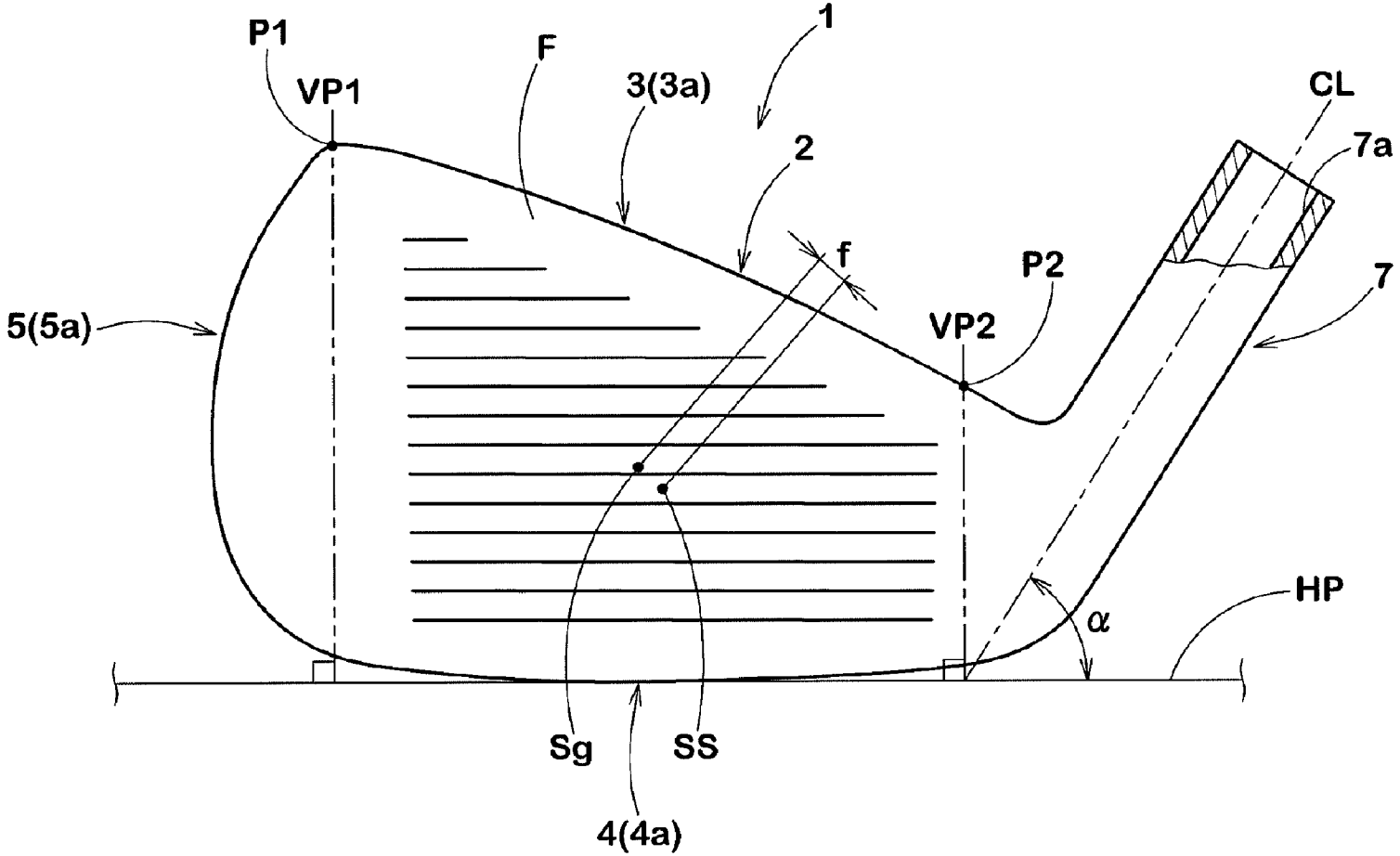
FIG. 1 is a front view of an iron-type golf club head according to the present invention.

Embodiments of present invention will now be described in detail in conjunction with the accompanying drawings.

In the drawings, the club head 1 according to the present invention comprises: a face portion 2 whose front surface forms the clubface F for striking a ball; a top portion 3 forming a top surface 3*a* of the head intersecting the upper edge of the clubface F at the upper edge of the clubface; a sole portion 4 forming a sole surface 4*a* which is the bottom surface of the head intersecting the clubface F at the lower edge of the clubface; a toe portion 5 forming a toe surface 5*a* extending between the sole surface 4*a* and top surface 3*a*; and a heel portion 6 provided with a tubular hosel 7 protruding upwardly therefrom and having a shaft inserting hole 7*a* into which a clubshaft (not shown) is inserted.

The top surface 3*a* is inclined downwardly toward the heel from the toe. A major part of the sole surface 4*a* extends substantially horizontally in the heel-and-toe direction. The toe surface 5*a* is curved convexly towards the outside.

In this specification, positions, directions and the like relating to the club head refer to those under a standard state of the club head unless otherwise noted. Here, the standard state of the club head is such that the club head is set on a horizontal plane HP so that the center line CL of the club shaft (not shown) is inclined at the lie angle $\alpha$ while keeping the club shaft center line CL on a vertical plane, and the clubface forms its loft angle $\beta$ with respect to the horizontal plane HP. Incidentally, in the case of the club head alone, the center line of the shaft inserting hole can be used instead of the center line of the club shaft.

The undermentioned sweet spot SS is defined as an intersecting point between the clubface F and a straight line N drawn perpendicularly to the clubface F from the center of gravity G of the head.

As shown in FIG. 1, the above-mentioned top surface 3*a* is defined as extending between vertical planes VP1 and VP2. The sole surface 4*a* is defined as extending between the vertical planes VP1 and VP2. The toe surface 5*a* is defined as existing on the toe-side of the vertical plane VP1. The heel portion 6 including the hosel 7 is defined as existing on the heel-side of the vertical plane VP2.

The vertical plane VP1 is defined as being perpendicular to the clubface F and including the highest point P1 of the clubface F. The vertical plane VP2 is defined as being perpendicular to the clubface F and including the intersecting point P2 of the center line CL and the horizontal plane HP.

The clubface F can be provided with so called impact area marking, namely, small grooves extending horizontally to increase the frictional force between the ball and clubface 2 at impact. Otherwise, the clubface 2 is flat. Therefore, the edge of the clubface 2 can be determined as the edge of the flat surface.

The area S of the clubface F is preferably set in a range of not less than 2400 sq·mm, more preferably not less than 3000 sq·mm, but not more than 5000 sq·mm, more preferably not more than 4500 sq·mm.

Figure 3:
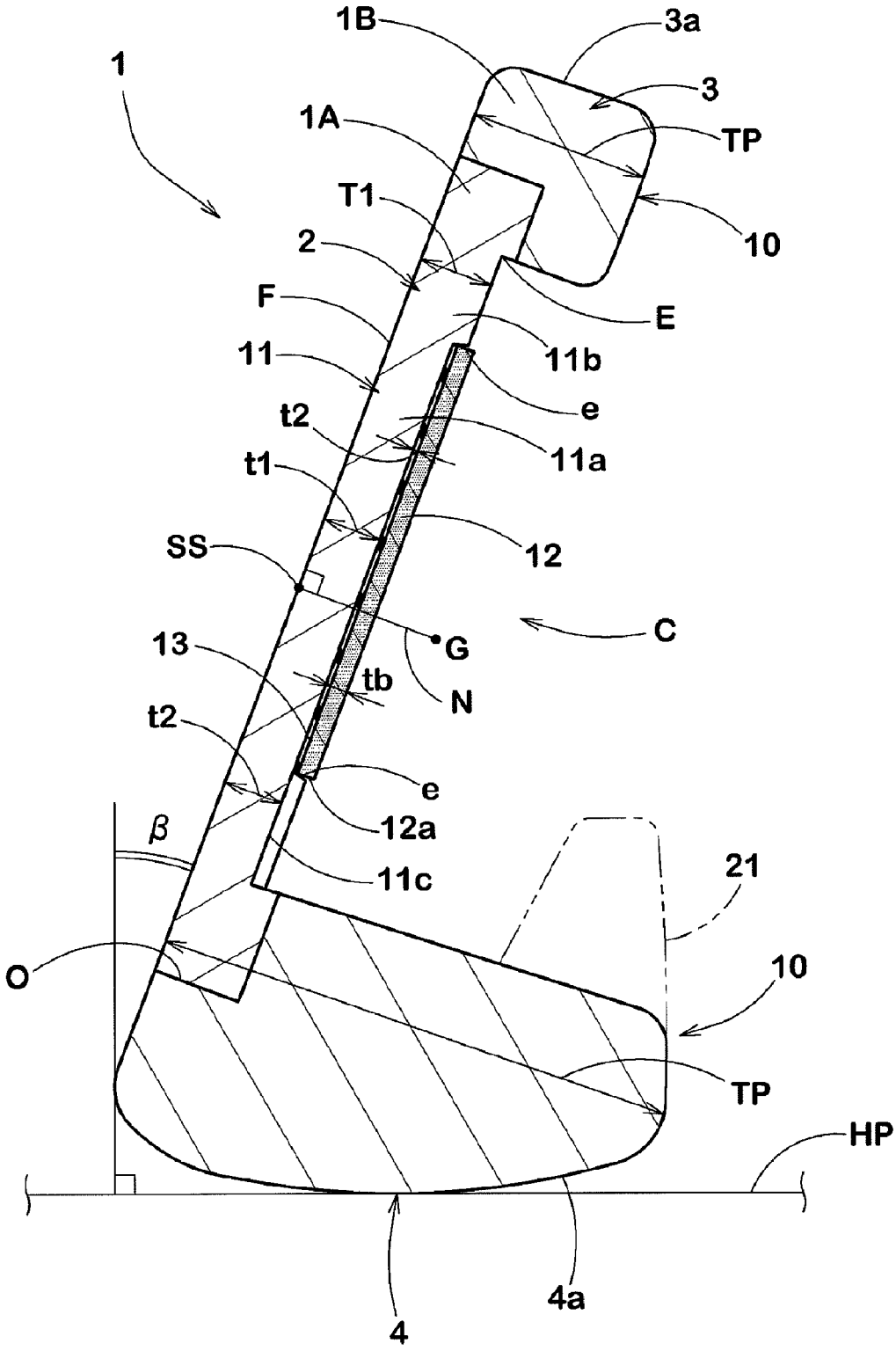
FIG. 3 is a cross sectional view thereof taken along line A-A in FIG. 2.
Figure 4:
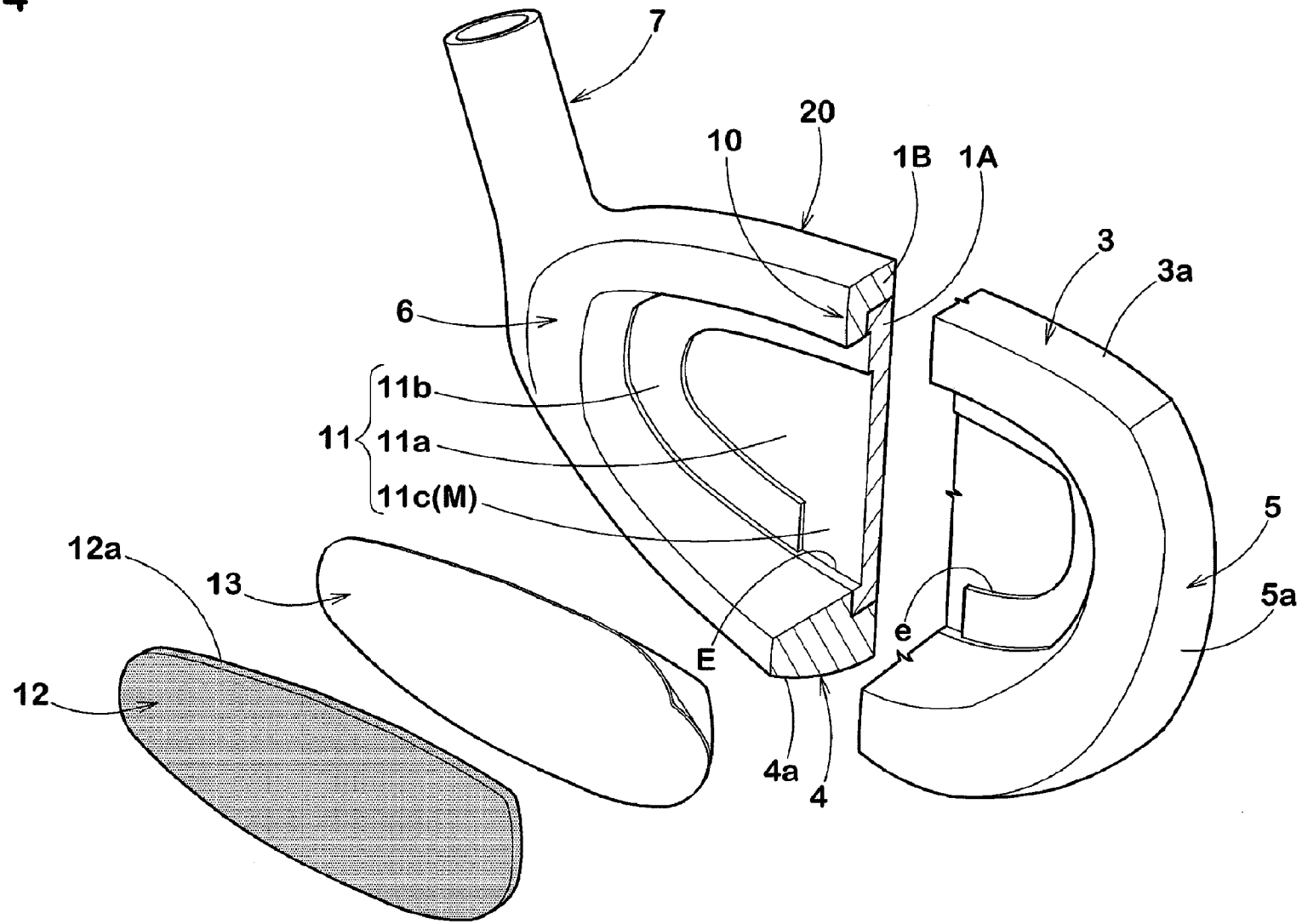
FIG. 4 is an exploded perspective view of the head.

In this embodiment, the club head 1 comprises a face plate 1A, a main body 1B and a badge 12 as best shown in FIG. 3 and FIG. 4.

The face plate 1A and main body 1B can be formed from a single metal material to have a one-piece structure through a suitable method for example casting, forging and the like. But, in this embodiment, in order to use different metal materials, the face plate 1A and main body 1B are formed separately.

The badge 12 is a thin plate made of a metal material, resin, viscoelastic material or the like.

The badge 12 is provided with a logo and the like, and attached to the backside of the face portion 2.

In order to control a resultant increase in the weight of the face portion, the thickness (tb) of the badge 12 is preferably set in a range of not less than 0.3 mm, more preferably not less than 0.5 mm, but not more than 2.0 mm, more preferably not more than 1.5 mm. As a result, vibrations of the face portion 2 are suppressed and the impact feeling can be improved.

In order to fix the badge 12, an adhesive such as an adhesive agent and a pressure sensitive adhesive double coated tape 13 can be used.

In the case of the adhesive tape, those having a carrier are preferred. AS for the carrier, a tissue paper type carrier, a resin/plastic film type carrier, a laminate of a tissue paper and a resin/plastic film, a laminate of resin/plastic films and a tissue paper sandwiched therebetween, and the like can be used. As to the material of the film, acrylic acid resins are preferred.

In any case, the overall thickness of the tape 13 is preferably set in a range of not less than 0.1 mm, more preferably not less than 0.2 mm, but not more than 0.4 mm, more preferably not more than 0.3 mm. The tape cut out into the substantially same size and shape as the badge 12 is used.

The face plate 1A is made of a metal material. For example, magnesium alloys, aluminum alloys, titanium alloys, stainless alloys, soft iron (low carbon steel having a carbon content of less than 0.3 wt %) and the like can be suitably used therefor. In this embodiment, a titanium alloy is used.

The main body 1B has a through hole into which the face plate 1A is fitted.

The main body 1B comprises an annular supporting frame 20 surrounding the through hole, and the above-mentioned hosel 7 formed integrally with the supporting frame 20.

The annular supporting frame 20 supports the outer circumferential surface of the face plate 1A and the peripheral edge part of the rear surface of the face plate 1A as shown in FIG. 3.

The head main body 1B is made of a metal material which preferably has a specific gravity larger than that of the face plate 1A. In this embodiment, a stainless alloy is used. Thereby, it becomes possible to lower the center of gravity of the head and to increase the moment of inertia of the head in order to improve the ballistic directions of the struck balls at missed shots.

In any case, the club head 1 according to the present invention is provided with a central part 11, and a backwardly protruding peripheral part 10 surrounding the central part 11. As a result, an open cavity c surrounded by the face peripheral part 10 is formed behind the clubface.

The peripheral part 10 in this embodiment is formed by the above-mentioned annular supporting frame 20. In order to deepen and lower the center of gravity of the head, the face peripheral part 10 has a maximum protrusion in the sole portion. Further, as shown in FIG. 3 by imaginary line, it is possible to form a backside wall 21 for the same purpose as above.

The central part 11 has an outline E similar to but smaller than the outline of the clubface F. In other words, the outline E of the central part 11 is almost parallel with that of the clubface F.

The area Sc of the central part 11 is preferably set to be not less than 30%, more preferably not less than 60% of the area S of the clubface F so that the face portion 2 can be deflected at impact to increase the carry distance of the ball. However, if the area becomes too large, there is a possibility that the moment of inertia and the durability of the face portion 2 are decreased, therefore, the area Sc is preferably not more than 90%, more preferably not more than 80% of the area s of the clubface F.

The central part 11 comprises:

a central thin region 11*a* to which the badge 12 is adhered;

a surrounding thicker peripheral region 11*b* extending discontinuously around the central thin region 11*a* to have at least one breaking part M; and at least one radial thin region 11*c* formed by the at least one breaking part M and extending radially from the central thin region 11*a* to the face peripheral part 10.

The central thin region 11*a* has a minimum thickness t1 which is substantially constant. The central thin region 11*a* includes the sweet spot SS substantially at the center thereof, and the distance (f) between the sweet spot SS and the centroid Sg of area of the central thin region 11*a* is not more than 20 mm, preferably not more than 10 mm, more preferably not more than 5 mm along the clubface F.

The thickness T1 of the surrounding thicker peripheral region 11*b*, which is substantially constant in this embodiment, is more than the thickness T1 of the central thin region 11*a* and less than the thickness TP of the face peripheral part 10.

As a result, as shown in FIG. 3, the surrounding thicker peripheral region 11*b* forms an inner peripheral surface (e) rising from the central thin region 11*a* by a small height corresponding to the difference T1−t1 and extending along the boundary between the central thin region 11*a* and surrounding thicker peripheral region 11*b*.

The space defined as being surrounded by the inner peripheral surface (e) has a shape substantially same as but slightly larger than the contour of the badge 12 so that the outer circumferential surface 12*a* of the badge 12 substantially contacts with the inner peripheral surface (e).

The radial thin region 11*c* is formed by the breaking part M of the surrounding thicker peripheral region 11*b*. The radial thin region 11*c* has a positive width from the central thin region 11*a* to the face peripheral part 10.

The thickness t2 of the radial thin region 11*c* is less than the surrounding thicker peripheral region 11*b* and not less than the thickness t1 of the central thin region 11*a*.

In order to avoid deterioration of the durability due to the thin regions 11*a* and 11*c*, the thickness ratio (t2/t1) is preferably set to be not more than 1.2, more preferably not more than 1.1, most preferably 1.0.

Preferably, the thickness t1 of the central thin region 11*a* is set to be not less than 1.5 mm, more preferably not less than 1.8 mm, still more preferably not less than 2.0 mm in order to prevent the durability from deteriorating. However, if the thickness t1 becomes excessively increased, there is a possibility that the coefficient of restitution is decreased and the club face weight is undesirably increased. Therefore, the thickness t1 is preferably not more than 3.0 mm, more preferably not more than 2.7 mm, still more preferably not more than 2.4 mm.

If the area s1 of the central thin region 11*a* is too small, it becomes difficult to obtain a sufficient coefficient of restitution. If the area s1 is too large, on the other hand, there is a possibility that the durability of the face portion 2 deteriorates. Therefore, the ratio (s1/S) of the area s1 of the central thin region 11*a* (namely, the badge bonding area) and the area s of the clubface F is preferably set in a range of not less than 0.20, more preferably not less than 0.40, still more preferably not less than 0.50, but not more than 0.90, more preferably not more than 0.80, still more preferably not more than 0.70.

Preferably, the area s1 of the central thin region 11*a* is set in a range of not less than 900 sq·mm, more preferably not less than 1000 sq·mm, still more preferably not less than 1100 sq·mm, but not more than 1700 sq·mm, more preferably not more than 1600 sq·mm, still more preferably not more than 1500 sq·mm.

If the thickness T1 of the surrounding thicker peripheral region 11*b* is decreased, the positioning of the badge 12 becomes difficult. Therefore, it is desirable that the thickness T1(mm) satisfies the following conditional expression (1), more preferably (2), still more preferably (3):

$$T1>=(t1+T2)+0.05, \quad (1)$$

$$T1>=(t1+T2)+0.10, \quad (2)$$

$$T1>=(t1+T2)+0.15. \quad (3)$$

If the thickness T1 becomes too large, on the other hand, since the rigidity of the face portion 2 is increased, there is a possibility that the coefficient of restitution becomes insufficient, therefore, it is preferable that the thickness T1(mm) satisfies the following conditional expression (4), more preferably (5):

$$T1=<(t1+T2)+0.30, \quad (4)$$

$$T1=<(t1+T2)+0.25. \quad (5)$$

Incidentally, in the case than the tape is not used to fix the badge 12, the thickness T2 of the tape 13 is zero.

In order to secure the durability of the central part 11, the ratio {Sp/(Sa+Sp)} of the total area sa of the surrounding thicker peripheral region 11*b* and the total area Sp of the radial thin region(s) 11*c* is preferably not more than 0.7, more preferably not more than 0.6, still more preferably not more than 0.5. However, if the ratio {Sp/(Sa+Sp)} becomes too small, the loss of the carry distance due to missed shot tends to increase, therefore, the ratio {Sp/(Sa+Sp)} is preferably not less than 0.1, more preferably not less than 0.2, still more preferably not less than 0.3.

In order to prevent a decrease in the coefficient of restitution while securing the durability of the central part 11, the area sa of the surrounding thicker peripheral region 11*b* is preferably set in a range of not less than 250 sq·mm, more preferably not less than 300 sq·mm, still more preferably not less than 400 sq·mm, but not more than 900 sq·mm, more preferably not more than 700 sq·mm, still more preferably not more than 600 sq·mm.

The total area Sp is preferably set in a range of not less than 100 sq·mm, more preferably not less than 300 sq·mm, still more preferably not less than 400 sq·mm, but not more than 750 sq·mm, more preferably not more than 700 sq·mm, still more preferably not more than 600 sq·mm.

Figure 2:
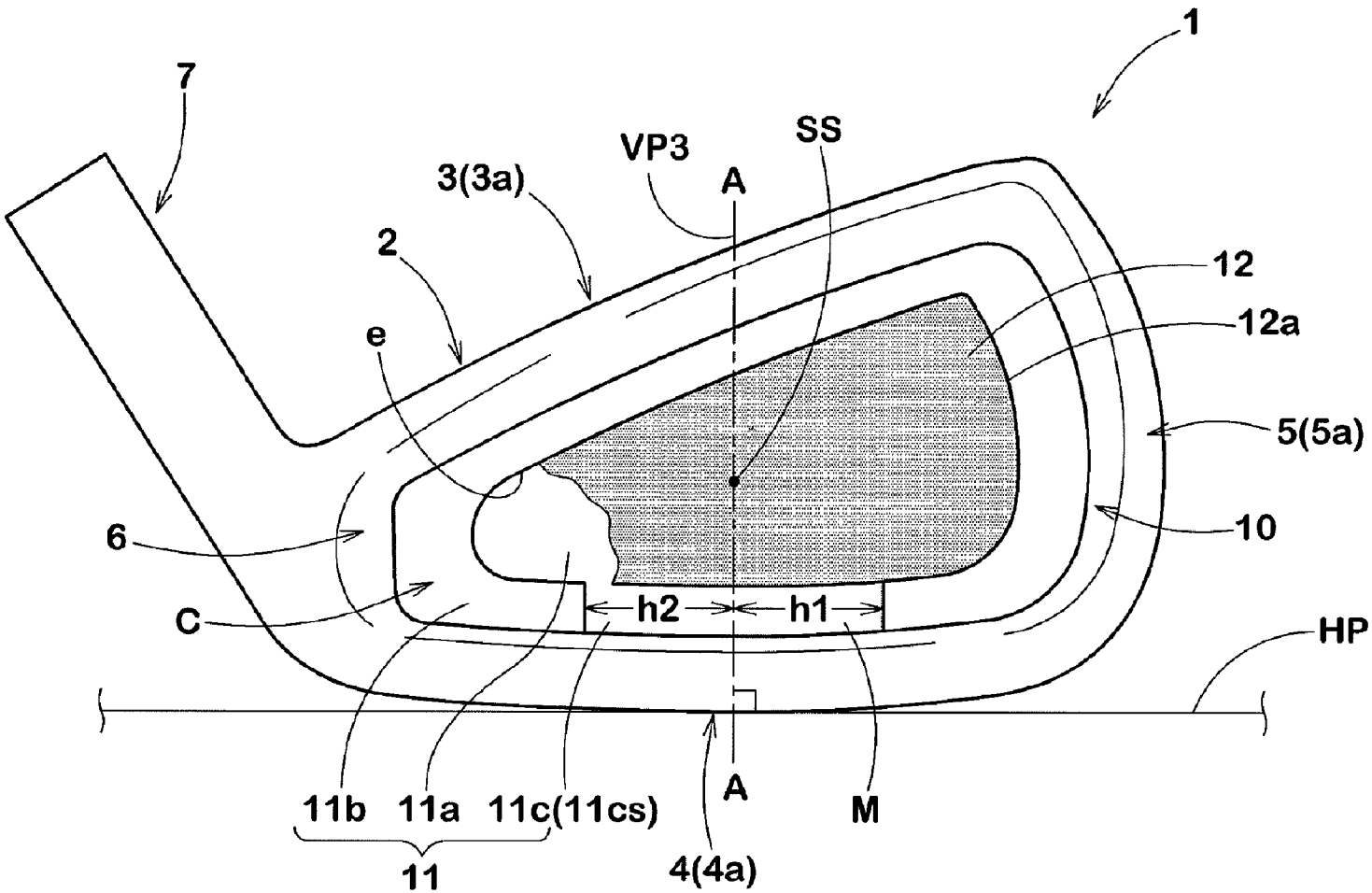
FIG. 2 is a rear view thereof.

In this embodiment, the radial thin region 11*c* is one sole-side radial thin region 11*cs* extending from the central thin region 11*a* toward the sole portion 4 to the face peripheral part 10. In the heel-and-toe direction, the sole-side radial thin region 11*cs* extends across a vertical plane VP3 which plane is defined as including the sweet spot SS and being perpendicular to the clubface F as shown in FIG. 2.

It is preferable that the sole-side radial thin region 11*cs* extends from the vertical plane VP3 toward the toe and toward the heel by distances h1 and h2 of at least 3 mm, preferably at least 5 mm, more preferably at least 10 mm.

In the case of iron-type golf clubs, there are lots of opportunities for hitting balls at positions on the sole-side of the sweet spot, therefore, by providing the sole-side radial thin region 11*cs*, the face portion 2 is well deflected and it becomes possible to improve the carry distance even when missed shots.

Figure 5:
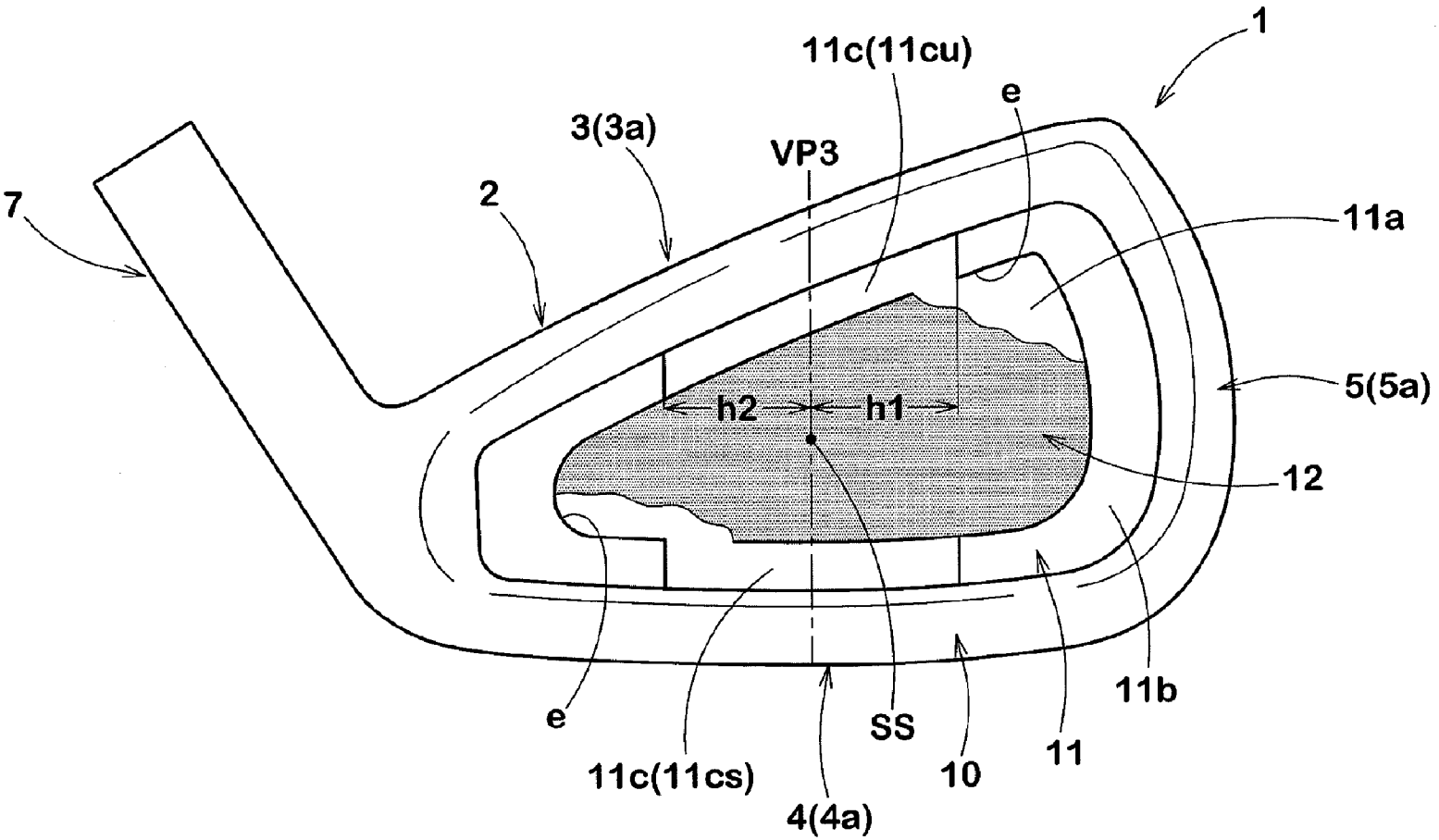
FIG. 5 and FIG. 6 are rear views of each showing another example of the iron-type golf club head according to the present invention.

FIG. 5 shows another example of the head 1.

In this example, in addition to the sole-side radial thin region 11*cs*, the radial thin region 11*c* includes one top-side radial thin region 11*cu* extending from the central thin region 11*a* toward the top portion 3 to the face peripheral part 10.

In this case too, it is preferable that the top-side radial thin region 11*cu* extends from the vertical plane VP3 toward the toe and toward the heel by distances h1 and h2 of at least 3 mm, preferably at least 5 mm, more preferably at least 10 mm. Thereby, the deflection of the face portion 2 can be further improved.

Figure 6:
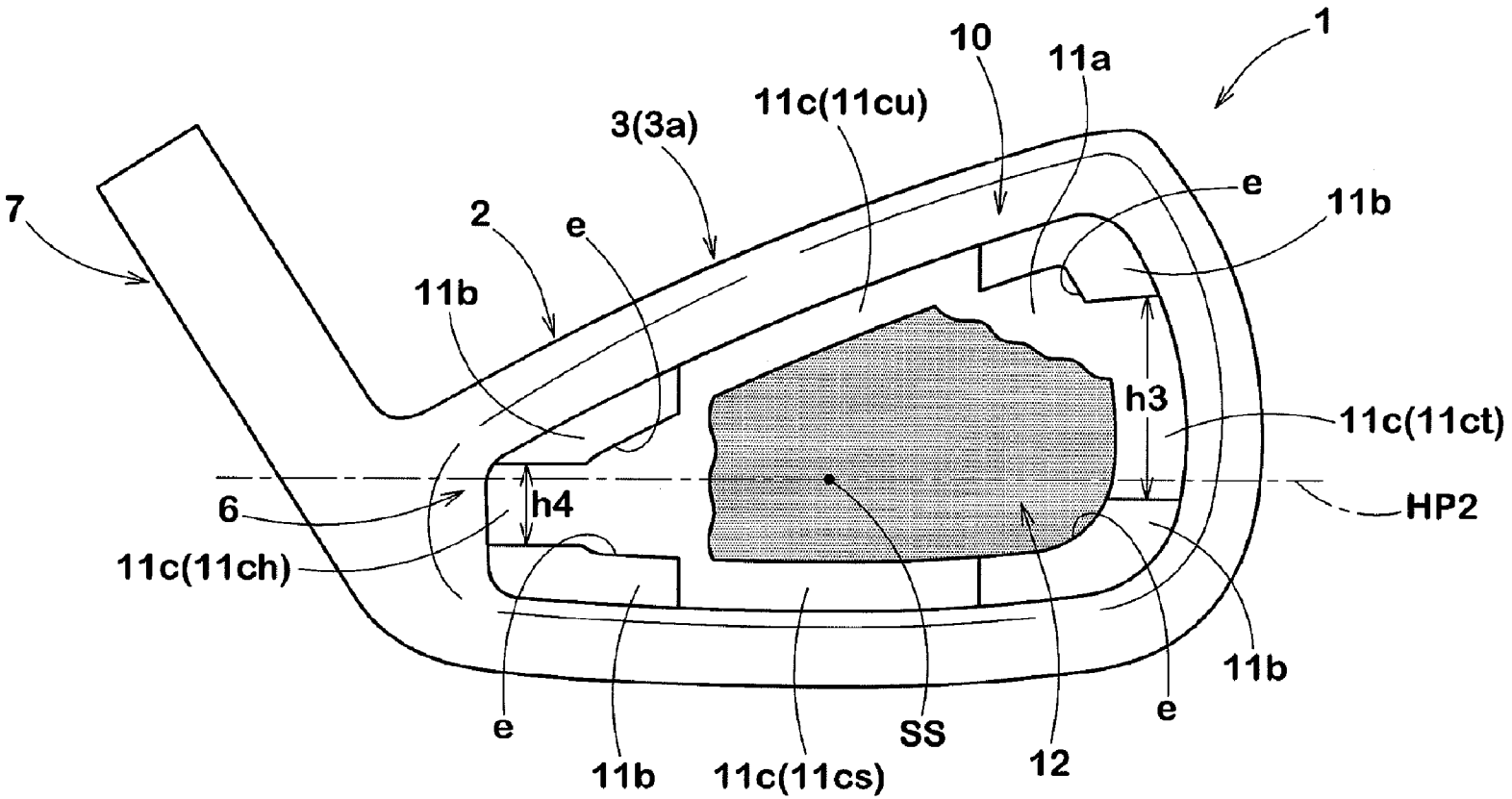

FIG. 6 shows still another example of the head 1. In this example, addition to the sole-side radial thin region 11*cs* and top-side radial thin region 11*cu*, the radial thin region 11*c* further includes: one toe-side radial thin region 11*ct* extending from the central thin region 11*a* toward the toe to the face peripheral part 10; and one heel-side radial thin region 11*ch* extending from the central thin region 11*a* toward the heel portion 6 to the face peripheral part 10.

The toe-side radial thin region 11*ct* and the heel-side radial thin region 11*ch* each extend across a horizontal plane HP2 including the sweet spot SS.

The width h3 of the toe-side radial thin region 11*ct* measured in the vertical direction along the clubface F and the width h4 of the heel-side radial thin region 11*ch* measured in the vertical direction along the clubface F are each preferably set in a range of not less than 5 mm, more preferably not less than 10 mm, still more preferably not less than 15 mm, but not more than 40 mm, more preferably not more than 35 mm. And the width h3 is larger than the width h4.

Thereby, it becomes possible to effectively deflect the face portion 2 to increase the carry distance on missed shots as well as sweet spot shots.

In any case, the total length L2 of the inner peripheral surface (e) is preferably not less than 0.10 times, more preferably not less than 0.20 times, still more preferably not less than 0.30 times, but not more than 0.90 times, more preferably not more than 0.80 times, still more preferably not more than 0.70 times the circumferential length L1 of the badge 12. If the total length L2 is less than 0.10 times the length L1, it becomes difficult to support and position the badge 12. If the total length L2 is more than 0.90 times the length L1, the coefficient of restitution is decreased.

The above-mentioned circumferential length L1 is preferably is about 120 to 170 mm.

In the case that the badge 12 has four corners as in the embodiments, it is preferable that the surrounding thicker peripheral region 11*b* is arranged to support the corners.

Incidentally, by inserting the end of the shaft into the hole 7*a* of the hosel 7, the iron-type golf club head 1 is attached to a club shaft (not shown) and an iron club is formed.

Golf Club Set

In general, when compared with a short iron club having a larger loft angle, a long iron club having a smaller loft angle is required to produce a longer carry distance.

Therefore, to meet such a requirement, a golf club set according to the present invention, includes three or more iron clubs having the heads 1 as described above.

More specifically, these heads 1 have different loft angles βi and different total areas Spi, which satisfy the following conditions:

$$\beta 1<\beta 2<---<\beta n$$

$$Sp1>=Sp2>=--->=Spn, \text{ and}$$

$$Sp1>Spn,$$

wherein

"i" is numbers from 1 to "n" assigned in the ascending order of the loft angle, and "n" is the number of the heads according to the present invention. The number "n" is not less than 3, preferably not less than 5.

Thus, the longer the club length, the wider the total area Sp of the radial thin region(s) 11*c*. As a result, it is possible to satisfy the above-mentioned requirement.

For example, it is possible that the club set includes:

an iron club whose head has a loft angle β1 and a total area Sp1 and the four radial thin regions 11*cs*, 11*cu*, 11*ct* and 11*ch;* an iron club whose head has a loft angle β2 and a total area Sp2 and the two radial thin regions 11*cs* and 11*cu*; and an iron club whose head has a loft angle β3 and a total area Sp3 and the radial thin regions 11*cs* only.

Figure 8A:
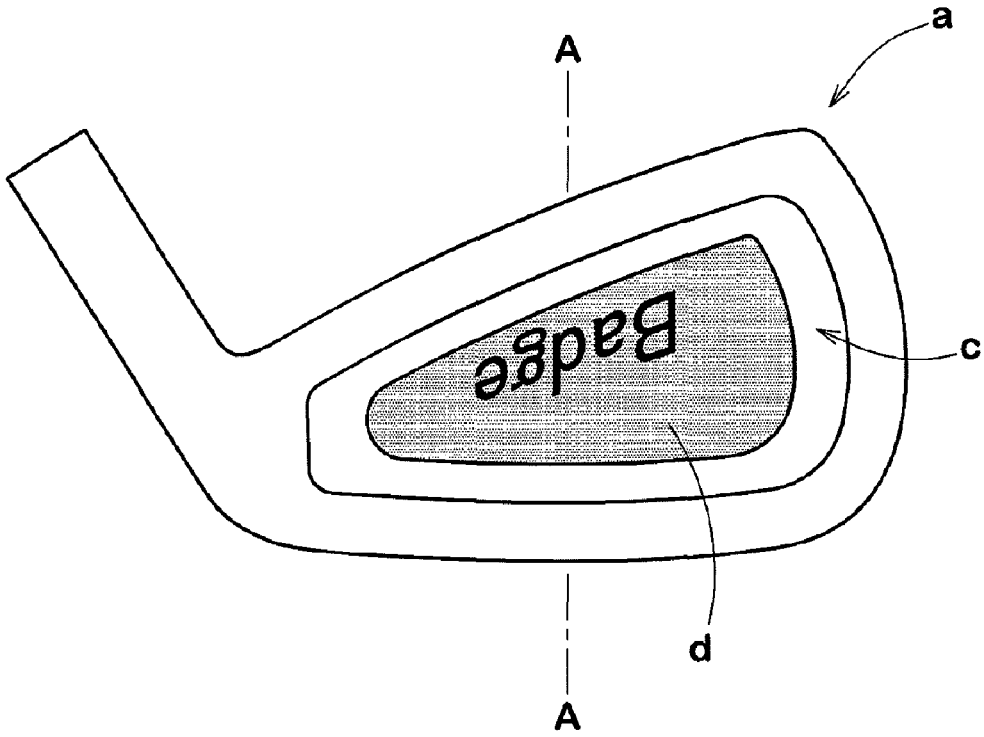
FIGS. 8(*a*) and 8(*b*) are a rear view and a cross sectional view of a club head used in the comparison tests.
Figure 8B:
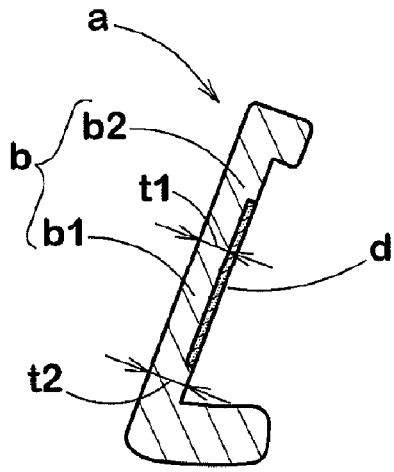

Further, in addition to the iron clubs having the heads 1 according to the present invention, the golf club set according to the present invention can include an iron club having a club head not according to the present invention, for example, a short iron club comprising a club head having a loft angle different from the above-mentioned loft angles βi, and having a face portion comprising a central part 11, a face peripheral part 10 surrounding the central part 11 and protruding backward therefrom to form a cavity, and a badge 12 disposed within the cavity, wherein the central part 11 comprises: a central thin region 11*a* having a minimum thickness t1 of the face portion and a rear surface to which the badge is attached; and a thicker peripheral region continuously extending around the badge without the breaking part as shown in FIG. 8 (namely, the total area Sp=0).

Comparison Tests

Club heads for five-iron having the specifications shown in Table 1 and the following common specifications were made and tested for the durability and coefficient of restitution.

Common Specifications:

Loft angle: 26 degrees
Club head weight: 249 grams
Main body
Material: SUS630
Face plate
Material: Ti-6Al-4V
Badge
Material: SUS304
Thickness: 0.3 mm
Weight: 4 grams
Area: 60% of club face area
Double coated tape: 3M "Y-4625"
Thickness: 0.25 mm Durability Test:

The club heads were attached to identical FRP shafts ("MP-400" manufactured by SRI sports Limited) to make five-iron clubs, and each club was mounted on a swing robot and hit golf balls 10,000 times (maximum) at the head speed of 54 m/s, while visually checking the club head every 100 times. If any damage was observed, the number of hits was recorded. The test results are shown in Table 1.

Restitution Coefficient Test:

According to the "Procedure for Measuring the velocity Ratio of a club Head for conformance to Rule 4-1e, Appendix II, Revision 2 (Feb. 8, 1999), united states Golf Association", the coefficient of restitution COR of each club head was obtained with respect to five hitting positions.

The five hitting positions were the sweet spot, and a top-side position, toe-side position, heel-side position and sole-side position at a distance of 10 mm from the sweet spot along the clubface toward the upside, toe-side, heel-side and down-side, respectively. The results are shown in Table 1, wherein the larger value the better.

TABLE 1

Figure 7A:
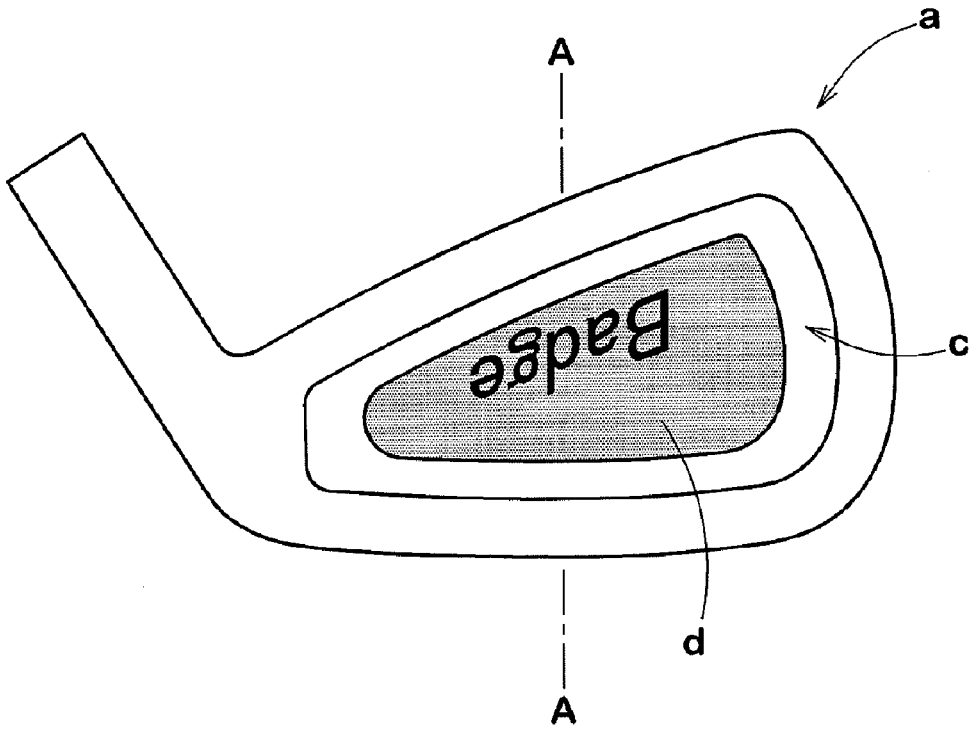
FIG.7(a) Conventional art
FIGS. 7(*a*) and 7(*b*) are a rear view and a cross sectional view of a club head used in the undermentioned comparison tests as a head according to the conventional art.
Figure 7B:
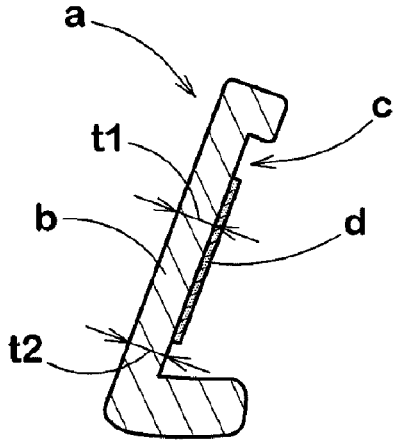
Figure 9A:
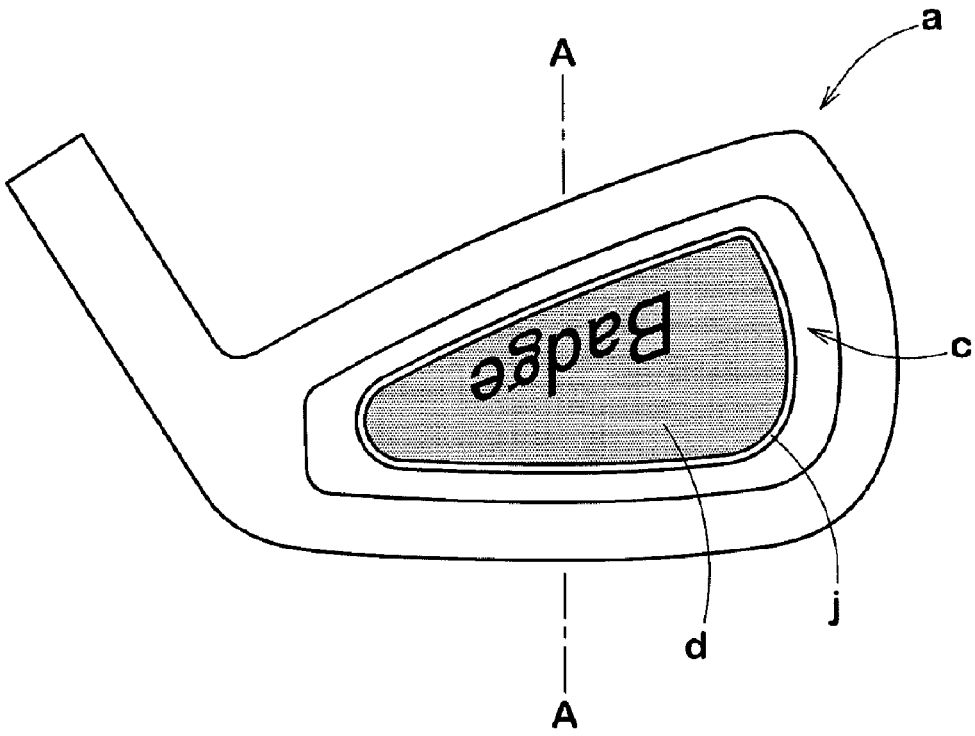
FIG.9(a) Prior art
FIGS. 9(*a*) and 9(*b*) are a rear view and a cross sectional view of a club head used in the undermentioned comparison tests as a head according to the prior art.
Figure 9B:
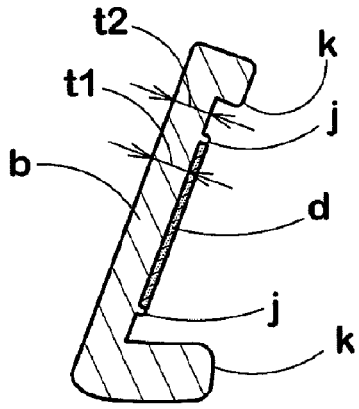

| Head | Ex. 1 | Ex. 2 | Ex. 3 | Ref. 1 | Ref. 2 | Ref. 3 | Ref. 4 |
|---|---|---|---|---|---|---|---|
| Structure | FIG. 2 | FIG. 5 | FIG. 6 | FIG. 8 | FIG. 7 | FIG. 9 | FIG. 9 |
| Badge | | | | | | | |
| Circumferential length L1(mm) | 150 | 150 | 150 | 150 | 150 | 150 | 150 |
| Thicker peripheral region | | | | | non | non | non |
| Total area Sa (sq.mm) | 800 | 700 | 500 | 1000 | — | — | — |
| Total length L2(mm) | 120 | 105 | 80 | 150 | — | — | — |
| L2/L1 | 0.80 | 0.70 | 0.53 | 1.00 | — | — | — |
| Thickness T1(mm) | 2.6 | 2.6 | 2.6 | 2.6 | — | — | — |
| Central thin region | | | | | | | |
| Area s1 (sq.mm) | 1500 | 1500 | 1500 | 1500 | 1500 | 1500 | 1500 |
| Thickness t1 (mm) | 2.2 | 2.2 | 2.2 | 2.2 | 2.2 | 2.6 | 2.2 |
| Radial thin region | | | | non | | | |
| Total area Sp (sq.mm) | 200 | 300 | 500 | — | 1000 | 1000(*) | 1000(*) |
| Thickness t2 (mm) | 2.2 | 2.2 | 2.2 | — | 2.2 | 2.6 | 2.2 |
| Sole-side | | | | non | non | non | non |

TABLE 1-continued

| Head | Ex. 1 | Ex. 2 | Ex. 3 | Ref. 1 | Ref. 2 | Ref. 3 | Ref. 4 |
|---|---|---|---|---|---|---|---|
| h1 (mm) | 25 | 25 | 25 | — | — | — | — |
| h2 (mm) | 10 | 10 | 10 | — | — | — | — |
| Top-side | non | | | non | non | non | non |
| h1 (mm) | | 25 | 25 | — | — | — | — |
| h2 (mm) | | 10 | 25 | — | — | — | — |
| Toe-side | non | non | | non | non | non | non |
| h3 (mm) | — | — | 30 | — | — | — | — |
| Heel-side | non | non | | non | non | non | non |
| h4 (mm) | — | — | 16.8 | — | — | — | — |
| Narrow rib surrounding Badge | non | non | non | non | non | | |
| Width (mm) | — | — | — | — | — | 1.0 | 1.0 |
| Height (mm) | — | — | — | — | — | 0.5 | 0.5 |
| Club face area S (sq.mm) | 2600 | 2600 | 2600 | 2600 | 2600 | 2600 | 2600 |
| s1/S | 0.58 | 0.58 | 0.58 | 0.58 | 0.58 | 0.58 | 0.58 |
| Sp/(Sp + Sa) | 0.20 | 0.30 | 0.50 | 0.00 | 1.00 | — | — |
| Thickness difference | | | | | | | |
| T1 − t1 − T2 (mm) | 0.20 | 0.20 | 0.20 | — | — | — | — |
| Test results | | | | | | | |
| Durability | | | | | | | |
| Damage | no | no | no | no | yes | no | yes |
| No. of hits | 10000 | 10000 | 10000 | 10000 | 6300 | 10000 | 7000 |
| COR | | | | | | | |
| Sweet spot | 0.816 | 0.817 | 0.819 | 0.815 | 0.821 | 0.814 | 0.820 |
| Top-side | 0.631 | 0.634 | 0.634 | 0.630 | 0.638 | 0.631 | 0.636 |
| Toe-side | 0.795 | 0.795 | 0.798 | 0.794 | 0.800 | 0.792 | 0.799 |
| Sole-side | 0.780 | 0.783 | 0.783 | 0.778 | 0.785 | 0.775 | 0.782 |
| Heel-side | 0.814 | 0.814 | 0.817 | 0.814 | 0.820 | 0.812 | 0.818 |

(*)inclusive of ribbed area

From the test results, it was confirmed that Example heads according to the present invention can increase the carrier distance without deteriorating the durability.

As described above, in the iron-type golf club head according to the present invention, due to the inner circumferential surface of the thicker peripheral region, the badge can be accurately positioned, and the movement of the badge during use can be prevented.

Further, as the thicker peripheral region extends from the face peripheral part to the central thin region, the width thereof is wide in comparison with the narrow rib, and as a result, the durability is prevented from deteriorating, rather improved. On the other hand, the central thin region and radial thin region can increases the deflection of the face portion at impact at the time of good shots at the sweet spot as well as miss shots off the sweet spot, and the carry distance can be improved.

The invention claimed is:

1. An iron-type golf club head comprising:

a hosel portion; and a face portion having a front surface forming a club face, said face portion comprising a central part, a face peripheral part surrounding the central part and protruding backward therefrom to form a cavity, and a badge disposed within the cavity, wherein the central part comprises:

a central thin region having a minimum thickness of the face portion and a rear surface to, which the badge is attached;

a thicker peripheral region surrounding the badge and having at least one breaking part, said thicker peripheral region having an inner circumferential surface for positioning the badge, raising from the rear surface of the central thin region adjacently to the outer circumferential surface of the badge; and at least one radial thin region formed by said at least one breaking part, and extending from the central thin region to the face peripheral part.

2. The head according to claim 1, wherein said at least one radial thin region has the same thickness as the central thin region.

3. The head according to claim 2, wherein said at least one radial thin region includes at least one of the following four radial thin regions:

a radial thin region extending towards the sole, a radial thin region extending towards the top, a radial thin region extending towards the toe, and a radial thin region extending towards the heel.

4. The head according to claim 1, wherein said at least one radial thin region includes at least one of the following four radial thin regions:

a radial thin region extending towards the sole, a radial thin region extending towards the top, a radial thin region extending towards the toe, and a radial thin region extending towards the heel.

5. A golf club set comprising a number "n" of golf clubs each having an iron-type golf club head set forth in claim 1, wherein the heads of the number "n" of the golf clubs have different loft angles βi and different total areas Spi of said at least one radial thin region, wherein "i" is numbers from 1 to "n" assigned in the ascending order of the loft angle, and the following conditions are satisfied:

$$\beta 1<\beta 2<\cdots<\beta n$$

$$Sp1>=Sp2>=\cdots>=Spn, \text{ and}$$

$$Sp1>Spn.$$

6. The golf club set according to claim 4, wherein said heads each provided with said at least one radial thin region include: the head provided with a radial thin region extending towards the sole; the head provided with a radial thin region extending towards the sole, and a radial thin region extending towards the top; and the head provided with a radial thin region extending towards the sole, a radial thin region extending towards the top, a radial thin region extending towards the toe, and a radial thin region extending towards the heel.

7. The golf club set according to claim 5, which further include an iron-type golf club having a head having a loft angle different from said loft angles βi, and a face portion comprising a central part, a face peripheral part surrounding the central part and protruding backward therefrom to form a cavity, and a badge disposed within the cavity, wherein the central part comprises: a central thin region having a minimum thickness of the face portion and a rear surface to which the badge is attached; and a thicker peripheral region continuously extending around the badge without the breaking part.

* * * * *